US011673144B1

(12) United States Patent
Messinger

(10) Patent No.: US 11,673,144 B1
(45) Date of Patent: Jun. 13, 2023

(54) EMBASSY PORTABLE ELECTRONIC DEVICE SHREDDER

(71) Applicant: Samuel Messinger, Ramot Bet Shemish (IL)

(72) Inventor: Samuel Messinger, Ramot Bet Shemish (IL)

(73) Assignee: Samuel Messinger, Ramot Bet Shemish (IL)

( * ) Notice: Subject to any disclaimer, the term of this patent is extended or adjusted under 35 U.S.C. 154(b) by 0 days.

(21) Appl. No.: 17/838,287

(22) Filed: Jun. 13, 2022

(51) Int. Cl.

| | |
|---|---|
| ***B02C 18/00*** | (2006.01) |
| ***B02C 18/08*** | (2006.01) |
| ***B02C 18/22*** | (2006.01) |
| ***B02C 21/02*** | (2006.01) |
| ***B02C 18/24*** | (2006.01) |
| *B02C 18/16* | (2006.01) |

(52) U.S. Cl.
CPC ..... *B02C 18/0007* (2013.01); *B02C 18/08* (2013.01); *B02C 18/2291* (2013.01); *B02C 18/24* (2013.01); *B02C 21/02* (2013.01); *B02C 2018/0015* (2013.01); *B02C 2018/162* (2013.01)

(58) Field of Classification Search
CPC ..... B02C 18/0007; B02C 18/08; B02C 18/2291; B02C 18/24; B02C 18/16; B02C 2018/0015; B02C 21/02
See application file for complete search history.

(56) References Cited

U.S. PATENT DOCUMENTS

| | | | | |
|---|---|---|---|---|
| 141,553 | A * | 8/1873 | Freeman | B02C 18/26 254/3 R |
| 160,996 | A * | 3/1875 | Moore | B02C 18/26 241/151 |
| 301,020 | A * | 6/1884 | Jagusch | B02C 18/0007 222/312 |
| 1,464,219 | A * | 8/1923 | Rosenkranz | B02C 18/08 241/243 |
| 2,870,969 | A * | 1/1959 | Moore | F25C 5/046 241/238 |
| 3,527,277 | A * | 9/1970 | Woods | B02C 18/00 156/70 |
| 7,757,987 | B2 | 7/2010 | Kolbet et al. | |
| 9,939,025 | B2 * | 4/2018 | Palmer | B02C 7/188 |
| 10,657,345 | B1 * | 5/2020 | Ebadian | B02C 25/00 |
| 2003/0006330 | A1 * | 1/2003 | Chang | B02C 18/0007 241/236 |

(Continued)

FOREIGN PATENT DOCUMENTS

| | | | | |
|---|---|---|---|---|
| CN | 104941745 | A * | 9/2015 | B02C 18/0007 |
| CN | 107890942 | A * | 4/2018 | B02C 18/24 |

(Continued)

*Primary Examiner* — Faye Francis

(57) ABSTRACT

Embassy's under siege have an immediate need to destroy electronic devices. An electronic shredder is provided. A hand crank as backup. This invention relates to a portable electronic shredder. Further, shredder relates to the shredding of electronic devices to a very small size so as to make the shredded remnants untraceable, wherein the mobiles and laptops, CPUs and monitors can be placed for disposing of, following which the electronic devices are exposed to a pulverizer. The pulverizer crushes and cuts the electronic devices to minute remnants. The portable shredder is lightweight, compact and portable, thus making it easy to transport to an e-waste stacked place.

12 Claims, 2 Drawing Sheets

(56) References Cited

U.S. PATENT DOCUMENTS

| | | | | |
|---|---|---|---|---|
| 2005/0009461 | A1* | 1/2005 | Palese | A22C 9/008 452/142 |
| 2006/0274352 | A1 | 12/2006 | Nakaguma et al. | |
| 2007/0029420 | A1* | 2/2007 | Radstrom | B02C 18/0007 241/236 |
| 2008/0245908 | A1* | 10/2008 | Romanovich | B02C 18/0007 241/227 |
| 2009/0140086 | A1* | 6/2009 | Thiel | B02C 18/148 241/27 |
| 2010/0327092 | A1* | 12/2010 | Romanovich | B02C 18/0007 241/166 |
| 2012/0091244 | A1* | 4/2012 | Loos | B02C 18/16 241/279 |
| 2013/0062444 | A1* | 3/2013 | Jensen | B02C 18/0007 241/36 |
| 2013/0320121 | A1* | 12/2013 | Ko | B02C 23/02 241/63 |
| 2015/0245925 | A1* | 9/2015 | Willyerd | B02C 18/144 241/28 |
| 2015/0328642 | A1* | 11/2015 | Shegerian | B02C 18/2216 241/37.5 |
| 2017/0203301 | A1* | 7/2017 | de Zárate | B02C 18/182 |
| 2022/0044208 | A1 | 2/2022 | Borowski et al. | |

FOREIGN PATENT DOCUMENTS

| | | | | |
|---|---|---|---|---|
| CN | 112844696 | A * | 5/2021 | 17/838 |
| CN | 113117845 | A * | 7/2021 | B02C 18/16 |
| DE | 4230219 | C1 * | 3/1994 | B02C 18/144 |
| DE | 19937735 | A1 * | 2/2001 | B02C 18/0007 |
| KR | 200414952 | Y1 * | 1/2006 | B02C 18/0007 |
| KR | 200428850 | Y1 * | 7/2006 | B02C 18/0007 |

* cited by examiner

200

EMBASSY PORTABLE ELECTRONIC DEVICE SHREDDER

TECHNICAL FIELD

The present invention generally relates to the portable electric shredder and more particularly relates to the shredding of electronic devices such a cell phones, laptops, external hard drives, ipads, towers, and other devices Where time is of the essence.

HISTORY

There exists a need to destroy on a moments notice electronic devices. This may happen at an embassy under sieges where employees identity and classified information such as diplomatic documents and to secret correspondence are at risk. Even under the best of circumstances information discovered this way is misunderstood and fuels the fire of rebellion as well as inducing physical violence to staff. The Rand Corporation has documents 1400 occurrences since 1968 including Teheran in 1968 and the Dominican Republics Embassy in Bogota 1980.

The present application relates generally to the shredding of mobiles and laptops, central processing unit, computer monitor, and electronic devices.

The present invention generally relates to the portable electrical shredder and more particularly relates to shredding electronic devices to a very small size so as to make the shredded remnants untraceable.

DISCUSSION OF THE HISTORY OF THE PROBLEM

The following discussion does not limit the invention disclosed in this patent application and does not expand the interpretation of any prior art, Thus, the discussion does indicate that any particular element of any existing system is unsuitable for use with the embodiments of the invention described herein, nor does it imply that any element is essential in implementing an embodiment of the invention.

Due to the new age of increased usage of electrical devices leading to the highest reach of electronic device production, a lot of e-waste has been created and has to be recycled to manufacture new products. Thus, an increase in the recycling process leads to a reduction in carbon waste as the shredded waste can be recycled into new products leading to zero wastage.

The shredders used are very heavy and very difficult to transport, but portable shredding device makes it easy for transporting to different places where they can be put into service to clean up the storage area dumped with old electronic devices. Conventional apparatus for shredding that delivers acceptable throughput rates produce shred sizing that generally is too large to be acceptable. A shredder may be used to cut or tear larger objects into smaller objects. Shredding may be useful in recycling materials or compacting them prior to disposing of them. But due to the heavyweight of the equipment, the shredder is placed in a particular place and material stocked for shredding has to be transported.

The disadvantage of the conventional system is that when the mobiles and laptops are broken down to untraceable remnants at the required area or location of stacked up e-waste. Thus, the present invention overcomes the transportation costs and time.

SUMMARY

In one of the embodiments, the present invention generally relates to the electrical shredder and more particularly relates to the shredding of electronic devices.

In one embodiment, the present invention relates to the shredding of unusable electronic devices such as laptops, computer monitors, CPUs, and mobile devices.

In one of the embodiments, the present invention relates to the portable electric shredder, for shredding electronic devices comprising mobiles, laptops, and CPUs. More particularly, the present application relates to the shredding of electronic devices to a very small size so as to make the shredded remnants untraceable.

In one of the embodiments, the portable electrical shredder more particularly relates to shredding electronic devices comprising disposing of electronic devices, ready and stocked before shredding, following which the electronic devices are exposed to a pulverizer.

In one of the embodiments, the portable shredder has a pulverizer as the core part for shredding the electronic devices, and the pulverizer crushes and cuts the electronic devices to minute remnants. Such a unit as Schredder Core 120 manufactured by Franklin Miller, Inc. of Livingston, N.J. (length 8' 2"×height 3' 5"×8' 3") modified as needed.

In an aspect herein, there is provided an electric shredder, the shredder including:

i. an inlet for disposing of the electronic devices;

ii. a pulverizer comprising offset blades driven power drive;

iii. a bin for collecting the shredded material and, or iv. a conveyor belt attached to transport the shredded material to the collecting bin;

BRIEF DESCRIPTION OF THE DRAWINGS

Various aspects of the invention and its embodiment are better understood by referring to the following detailed description. To understand the invention, the detailed description should be read in conjunction with the drawings, in which.

DESCRIPTION OF AN EXEMPLARY PREFERRED EMBODIMENT

Interpretation Considerations

Figure 1:
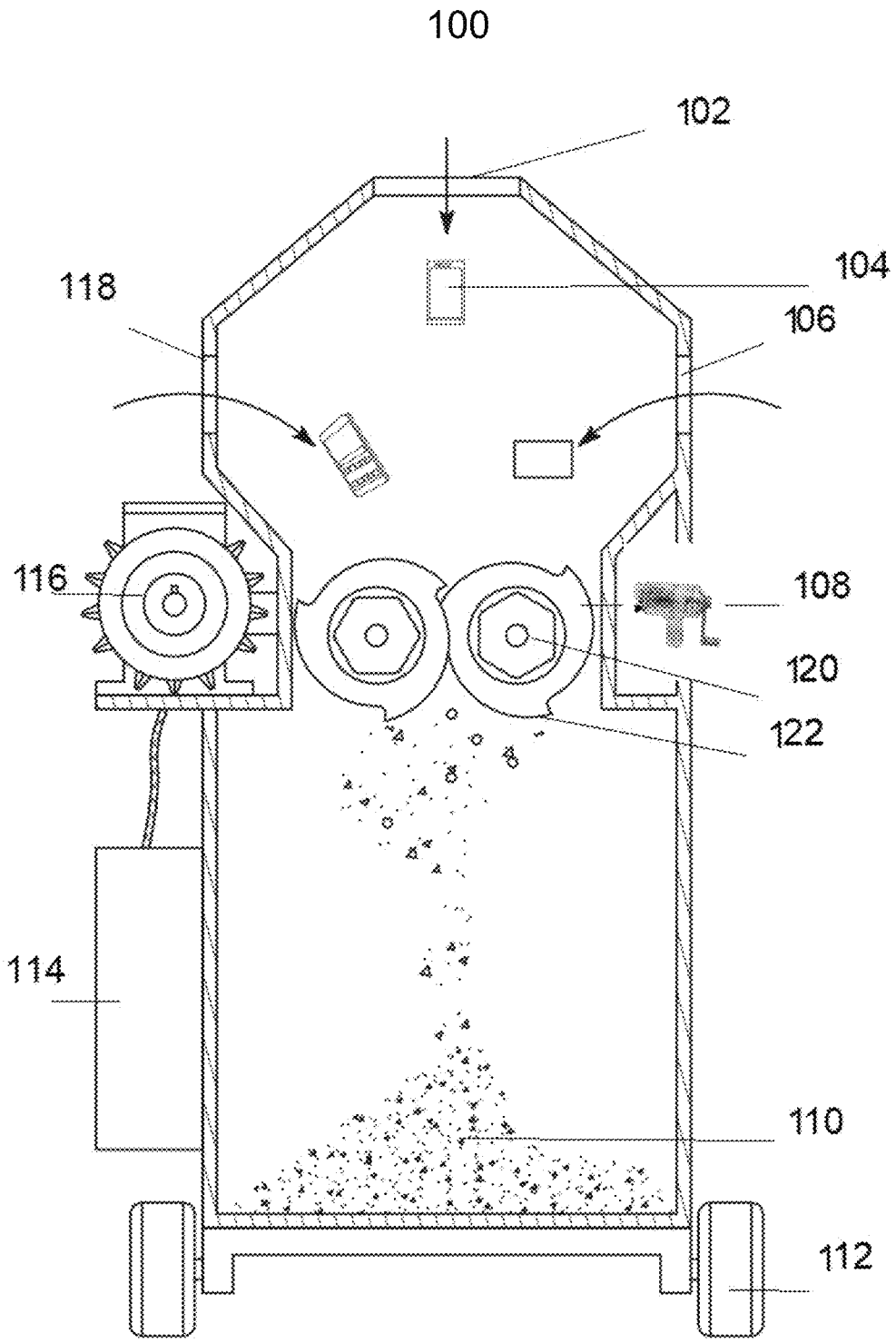
FIG. 1, a perspective view of an embodiment of an electronic portable shredder is shown generally as 100.

While reading this section (Description of an Exemplary Preferred Embodiment, which describes the exemplary embodiment of the best mode of the invention, hereinafter referred to as "exemplary embodiment"), one should consider the exemplary embodiment as the best mode for practicing the invention during filing of the patent in accordance with the inventor's belief. As a person with ordinary skills in the art may recognize substantially equivalent structures or substantially equivalent acts to achieve the same results in the same manner, or in a dissimilar manner, the exemplary embodiment should not be interpreted as limiting the invention to one embodiment.

The discussion of a species (or a specific item) invokes the genus (the class of items) to which the species belongs as well as related species in this genus. Similarly, the recitation of a genus invokes the species known in the art. Further-more, as technology develops, numerous additional alternatives to achieve an aspect of the invention may arise. Such advances are incorporated within their respective genus and should be recognized as being functionally equivalent or structurally equivalent to the aspect shown or described. Unless explicitly stated otherwise, conjunctive words (such as "or", "and", "including", or "comprising") should be interpreted in the inclusive and not the exclusive sense.

As will be understood by those of the ordinary skill in the art, various structures and devices are depicted in the block diagram to not obscure the invention. In the following discussion, acts with similar names are performed in similar manners, unless otherwise stated. The foregoing discussions and definitions are provided for clarification purposes and are not limiting. Words and phrases are to be accorded their ordinary, plain meaning unless indicated otherwise. The following definitions relate to the terms used in the present invention comprising:—

1. Shredder is defined as a machine or other device for shredding.
2. Pulverizer is equipment for reducing (as by crushing, beating, or grinding) very small particles.
3. E-waste is defined as E-waste is electronic products that are unwanted, not working, and nearing or at the end of their "useful life." Computers, televisions, VCRs, stereos, copiers, and fax machines.
4. Cabinets are defined as a piece of furniture with shelves, drawers, etc., for holding or displaying items: a curio cabinet; or a file cabinet.
5. Hand crank generator is A hand crank generator includes a crank, a gear transmission, and a generation motor-generator driven by the gear transmission. The crank and the gear transmission are coupled to each other. A clutch gear is coupled between the crank and the gear.

In one of the embodiments, the present invention relates to in detail the crushing, shredding, and disposing of e-waste to untraceable remnants. This allows obtaining the maximum versatility of use, low consumption, and the possibility of using the contributions provided for the purchase of equipment powered by alternative fuels. Moreover, the continuous research to minimize the environmental impact, over the years has led to the development of a technology capable of significantly reducing the emissions of noise and dust generated by conventional shredders.

DESCRIPTION OF THE DRAWINGS, A PREFERRED EMBODIMENT INTRODUCTION

The invention generally relates to an environmentally resilient portable shredder.

The invention provides an effective solution for the environment by shredding the e-waste to produce reusable and recycled products at the required location.

DESCRIPTION OF THE FIGURE

Referring first to FIG. 1, a perspective view of an embodiment of an electronic shredder is shown generally as 100. Further, the portable lightweight shredder is explained in detail as the lightweight portable electronic shredder that can be used installed at the embassies, electronic sale showrooms, markets, railway stations, and other e-waste collection counters, etc and has inlets 102, 104, and 118 consecutively for dropping e-waste into the shredder, 108 is the hand crank generator, and 120 is the pulverizer with blades 122. Further, 110 is the shredded material collected, and 112 is a pair of tires installed at the bottom of the shredder to conveniently move it from place to place. The Electronic devices include but not limited to towers, laptops, cell phones, portable memory drives, screens, memory boards, memory chips. In an embodiment, an electronic motor 116 is affixed on the outer wall of the electronic shredder 100 connected with the rechargeable battery 114 using wires to receive an electric energy for rotation of the electric motor 116. In an embodiment, the rotating shaft of the electronic motor 116 travels across the side wall of the main body of the electronic shredder 100 and coupled with the rotating shaft of the blades 122 to automatically rotate the blades of the pulverizer using the electricity and shred the electronic devices 104 disposed into the electronic shredder 100.

Figure 2:
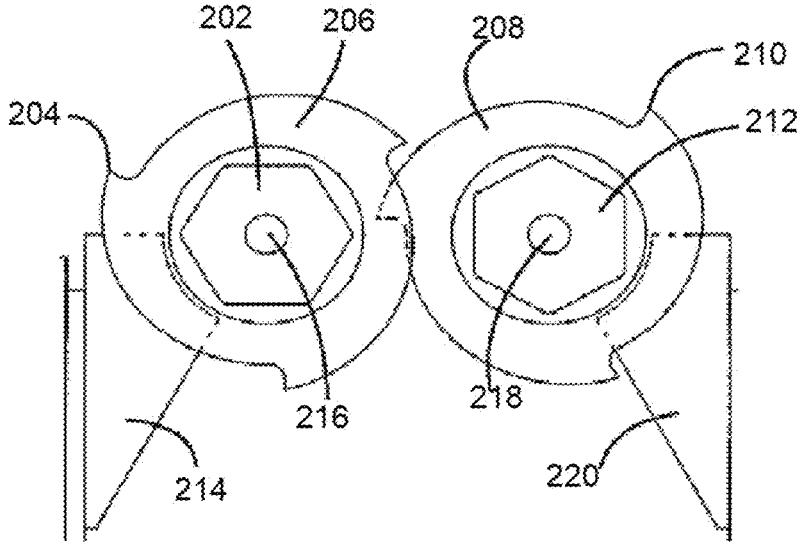
FIG. 2, a detailed view of pulverizer 200 of the electronic shredder.

Referring now to FIG. 2 an end view of the pulverizer, comprising each cutting knife 202 and 210, has three material capture hooks 204, but as one skilled in the art can appreciate, any number of material capture hooks 204 may be employed. In addition, cleaning blades 214 and 220 are disposed of between each cutting knife 202 to scrape away paper build-up between the cutting knives 206. Driveshafts 218 turn hexagonal shafts 212 which then turn cutting knives 202. In one embodiment hexagonal shafts, 212, and cutting knives 202. Power for the shredders is provided by battery as backup and feature 216 (not shown). Examples would be 460 volts AC at 60 Hz., or 220 volts AC. Note that an infeed conveyor (not shown) and a discharge conveyor (not shown) are optional elements.

A portable shredding apparatus for electronic devices, comprises a main body having a linear side walls, a top curved walls and a base, wherein the main body accommodates all equipment of the shredding apparatus; a pulverizer comprising a plurality of blades configured beside each other rotating in synchronization to pulverize the electronic devices; a hand crank generator mounted on an outer side of the main body in line with the pulverizer, wherein an output rotating shaft of the hand crank generator passes across the linear side wall and coupled with the drive shaft of the pulverizer; and a plurality of inlets on the top curved walls and the linear side walls for disposing the electronic devices for shredding. In an embodiment, the pulverizer is configured at the middle of an inner side of the main body. In an embodiment, the drive shaft is coupled with the hexagonal shaft on which the plurality of blades is mounted. In further embodiment, the one or more capture hooks are formed on each of the plurality of blades.

In an embodiment, the hand crank generator comprises a hand lever extending out for grasping and manual rotation of the hand crank generator. In an embodiment, the electronic motor configured on an outer side of the main body in line with the pulverizer, wherein the electronic motor is configured aligning the pulveriser and also coupled with the drive shaft of the pulverizer to rotate automatically using electric energy. In an embodiment, the portable shredding apparatus further comprises a rechargeable battery mounted on the outer side of the main body, the rechargeable battery is connected with the electronic motor. In an embodiment, the plurality of wheels is configured at the bottom of the shredding apparatus. The shredded electronic device gets collected within a collection chamber formed within the main body between the base and the pulverizer. In an embodiment, the portable shredding apparatus comprises a steering mechanism (not shown) coupled with the bottom wheels for navigation of the apparatus on aisles of embassy.

The above-described embodiments of the invention are intended to be examples only. Alterations, modifications, and variations can be effected to the particular embodiments by those of skill in the art without departing from the scope of the invention, which is defined solely by the claims appended hereto.

The invention claimed is:

1. A portable shredding apparatus for electronic devices, comprising:

a vertical main body having linear side walls, top curved walls and a base;

a shredder configured within the main body and comprising a plurality of blades configured beside each other rotating in synchronization to pulverize the electronic devices and a drive shaft;

a hand crank generator mounted on an outer side of the vertical main body in line with the pulverizer, wherein an output rotating shaft of the hand crank generator passes across the linear side wall and coupled with the drive shaft of the shredder; and a plurality of inlets on the top curved walls and the linear side walls of the vertical main body for disposing the electronic devices for shredding.

2. The portable shredding apparatus of claim 1, wherein the shredder is configured at the middle of an inner side of the vertical main body.

3. The portable shredding apparatus of claim 1, wherein the drive shaft is coupled with a hexagonal shaft on which the plurality of blades is mounted.

4. The portable shredding apparatus of claim 1, wherein one or more capture hooks are formed on each of the plurality of blades.

5. The portable shredding apparatus of claim 1, wherein the hand crank generator comprises a hand lever extending out for grasping and manual rotation of the hand crank generator.

6. The portable shredding apparatus of claim 1 further comprises an electronic motor configured on an outer side of the vertical main body in line with the shredder.

7. The portable shredding apparatus of claim 6, wherein the electronic motor is configured aligning the shredder and also coupled with the drive shaft of the shredder to rotate automatically using electric energy.

8. The portable shredding apparatus of claim 1 further comprises a rechargeable battery mounted on the outer side of the vertical main body.

9. The portable shredding apparatus of claim 8, wherein the rechargeable battery is connected with the electronic motor.

10. The portable shredding apparatus of claim 1, wherein a plurality of wheels is configured at the bottom of the shredding apparatus.

11. The portable shredding apparatus of claim 1, wherein the shredded electronic device get collected within a collection chamber formed within the vertical main body between the base and the shredder.

12. The portable shredding apparatus of claim 1, wherein the electronic devices is any of a tower, laptops, cellphones, portable memory drives, screens, memory boards and memory chips.

* * * * *